US009136044B2

(12) United States Patent
Lindstrom et al.

(10) Patent No.: US 9,136,044 B2
(45) Date of Patent: Sep. 15, 2015

(54) SHIELDED PAIR CABLE AND A METHOD FOR PRODUCING SUCH A CABLE

(75) Inventors: Marcus Lindstrom, Hudiksvall (SE); Hans Nilsson, Nasviken (SE); Dietmar Gleich, Falun (SE); Curt Erik Johansson, Hudiksvall (SE); Hans Ullberg, Hudiksvall (SE)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 549 days.

(21) Appl. No.: 13/415,349

(22) Filed: Mar. 8, 2012

(65) Prior Publication Data

US 2012/0227998 A1 Sep. 13, 2012

Related U.S. Application Data

(60) Provisional application No. 61/450,811, filed on Mar. 9, 2011.

(51) Int. Cl.
*H01B 7/17* (2006.01)
*H01B 11/10* (2006.01)

(52) U.S. Cl.
CPC ..... *H01B 11/1025* (2013.01); *Y10T 29/49194* (2015.01)

(58) Field of Classification Search
CPC ..... H01B 11/02; H01B 11/06; H01B 11/08; H01B 11/10; H01B 7/0861
USPC ..... 174/36, 113 R
See application file for complete search history.

(56) References Cited

U.S. PATENT DOCUMENTS

| | | | | |
|---|---|---|---|---|
| 5,936,203 | A | 8/1999 | Ryman | |
| 6,815,611 | B1 * | 11/2004 | Gareis | 174/36 |
| 7,649,142 | B2 | 1/2010 | Archambeault et al. | |
| 2005/0029007 | A1 | 2/2005 | Nordin et al. | |
| 2007/0037419 | A1 * | 2/2007 | Sparrowhawk | 439/98 |
| 2008/0308289 | A1 | 12/2008 | Archambeault et al. | |

FOREIGN PATENT DOCUMENTS

GB 2 127 621 A 4/1984

* cited by examiner

*Primary Examiner* — Chau N Nguyen
(74) *Attorney, Agent, or Firm* — Roger S. Burleigh

(57) ABSTRACT

The present invention concerns a cable for signal transmission and a method for producing such a cable. The cable comprises one or more wire pairs extending in a longitudinal direction, each of said wire pairs including two conductors each separately surrounded by a dielectric layer. At least one of said one or more wire pairs comprises a conductive shield being wrapped in a rotational direction along and about the longitudinal axis of the wire pair such that a longitudinal side of a wrap overlaps a preceding wrap. The conductive shield is applied with an angle (θ) that differs between different wraps such that the conductive shield lay length (L) varies along the length of said cable.

12 Claims, 5 Drawing Sheets

SHIELDED PAIR CABLE AND A METHOD FOR PRODUCING SUCH A CABLE

CROSS-REFERENCE TO RELATED APPLICATIONS

This application claims the benefit of European Patent Application EP 11157415 filed on Mar. 9, 2011, and U.S. Provisional Application 61/450,811, filed on Mar. 9, 2011, the disclosures of which are incorporated herein by reference.

TECHNICAL FIELD

The present invention relates to a shielded pair cable and a method for producing such a cable.

BACKGROUND

One type of signal cable is a twisted pair cable. Each pair in such a cable consists of two insulated conductive wires twisted together. The wire pairs are twisted since it reduces crosstalk and noise susceptibility. An electrical conducting foil can be applied around each pair and work as a shield improving the crosstalk performance and stabilizing impedance.

Another type of signal cable is a twinaxial cable. A twinaxial cable consists of two insulated, non-twisted, conductors surrounded by an outer conductor. The outer conductor being usually a foil or similar and works as a conductive shield that reduces electrical noise from other signals of the cable as well as electromagnetic radiation. The entire assembly is then covered with an insulating and protective outer layer.

Twisted pairs and parallel/twinaxial pairs that are screened/shielded are frequently used in high-frequency copper links. The shield helps addressing crosstalk problems but puts very high requirements for balancing the symmetry of the cable. Even a small difference in capacitance of the signal wires leads to magnification of screen currents and rise of common mode propagation. The losses of energy of the differential signal to common mode not only reduces immunity of the link but also its propagation quality as the modes travel with different speed and have unpredictable frequency characteristics.

The conductive shield surrounding the insulated conductors of the above mentioned types of signal cables can be applied in various ways. One known solution for twisted pair cables is to helically wrap the conductive shield around the twisted pair in the same operation as the pair is twisted. This implies that the shield has the same lay length, i.e. the degree of twisting per unit length, as the pair itself. This result in that a longitudinal side of each wrap of the conductive shield overlaps the preceding wrap and that the overlap of the shield will be fixed in respect to the conductor's orientation. The overlap causes imbalances to be introduced, which degrades performance at high frequencies.

The conductive shield can also be helically applied to twinaxial cables. This introduces however structural impedance variations that create an upper limit for the usable frequency span. The periodic overlap causes a structure in which propagation of electromagnetic waves is deteriorated within a range of frequencies (stopband), whereby signals within this frequency range are attenuated. U.S. Pat. No. 7,649,142B2 discloses a twinaxial cable for high speed data communication with a helically wrapped conductive shield that overcomes some of these drawbacks. The conductive shield is applied using a tape with a variable width, which reduces the attenuation of signals having frequencies within a stopband by spreading the attenuation across multiple frequencies. Thereby the maximum attenuation of the signals in the stopband is decreased and spread out to frequencies outside of the stopband. The solution in U.S. Pat. No. 7,649,142B2 requires however potentially expensive, special types of conductive shield tape. Further, an increase in attenuation may appear in frequencies outside of the stopband.

In addition, cables with helically wrapped conductive shields experience a phenomenon known as "signal suck-out" or resonance, whereby high signal attenuation occurs at a particular frequency range.

A different way to apply the conductive shield is to apply the shield longitudinally. The shield is then not helically wrapped around the insulated conductors, but is applied longitudinally in a cigarette-wrap configuration with a longitudinal seam extending along the length of the cable. It is however difficult to manufacture cables using this method without imbalances to be introduced.

The known solutions of applying conductive shields to cables all result in one or more drawbacks irrespective of whether the conductive shields are applied in a helical or longitudinal fashion.

SUMMARY

An object of the present invention is therefore to provide a cable that overcomes at least one of the drawbacks mentioned in connection with cables having wire pairs provided with conductive shields.

A cable for signal transmission is thus provided. The cable comprises one or more wire pairs extending in a longitudinal direction. The wire pairs include two conductors each separately surrounded by a dielectric layer. At least one of the wire pairs comprises a conductive shield that is wrapped along and about the longitudinal axis of the wire pair in a rotational direction and with an angle towards the longitudinal axis such that a longitudinal side of a wrap overlaps a preceding wrap. The conductive shield being applied with an angle that differs between different wraps such that the conductive shield lay length varies along the length of said cable. Preferably the conductive shield is of a constant width.

An advantage with such a cable is that the variation of the conductive shield lay length along the cable length cancels out some of the imbalances generated by the overlaps.

Another advantage is that the high frequency "suck out" that occurs for wire pairs with helical wrapped conductive shields is reduced.

In a preferred embodiment of the invention said one or more wire pairs are twisted wire pairs being twisted together along the length of the cable. The twisted wire pair has a pair lay length being substantially the same throughout the length of said cable.

An advantage with a cable according to this embodiment is that it is easily manufactured since the conductive shield can be applied in the same operation as the pairs are twisted in a twisting machine.

In another embodiment a cable for signal transmission comprising one or more twisted wire pairs are provided. Each wire pair extend in a longitudinal direction and include two conductors each separately surrounded by a dielectric layer. At least one of the wire pairs comprises a conductive shield that is wrapped along and about the longitudinal axis of the wire pair in a rotational direction and with an angle towards the longitudinal axis such that a longitudinal side of a wrap overlaps a preceding wrap. One or more of the twisted wire pairs is/are provided with a pair lay length that varies along the length of said cable.

An advantage with such a cable is that the varying relationship between the conductive shield lay length and the pair lay length along the cable length will cancel out some of the imbalances.

Another advantage is that the high frequency "suck out" that occurs for wire pairs with helical wrapped conductive shields is reduced.

The present invention is also directed to a method for producing a cable for signal transmission. The cable comprises one or more wire pairs extending in a longitudinal direction. The wire pairs include two conductors each separately surrounded by a dielectric layer. The method comprises the step of applying a conductive shield onto each wire pair by wrapping the conductive shield along and about the longitudinal axis in a rotational direction and with an angle towards the longitudinal axis such that a longitudinal side of a wrap overlaps the preceding wrap. The step of applying the conductive shield comprises the step of varying the angle with which the conductive shield is applied such that the conductive shield lay length varies along the length of said cable.

Advantages with such a method include that it is easy to produce a cable that experiences the advantages with cancelled imbalances and reduced high frequency "suck out".

In a preferred embodiment the method comprises twisting the wire pairs together along the length of the cable, such that each twisted wire pair has a pair lay length that is substantially the same throughout the length of the cable.

An advantage with this embodiment is that a cable is easy to manufacture since the conductive shield can be applied in the same operation as the pairs are twisted in a twisting machine.

In another embodiment the present invention also concerns a method for producing a cable for signal transmission, the cable comprising one or more twisted wire pairs extending in a longitudinal direction. The wire pairs include two conductors each separately surrounded by a dielectric layer. The method comprises the step of applying a conductive shield onto each wire pair by wrapping the conductive shield along and about the longitudinal axis in a rotational direction and with an angle towards the longitudinal axis such that a longitudinal side of a wrap overlaps the preceding wrap. The method further comprises the step of twisting the wires in a wire pair together along the length of said cable wherein the twist rate with which the wire pairs are twisted is varied, such that the pair lay length varies along the length of said cable.

Advantages with such a method include that it is easy to produce a cable that experiences the advantages with cancelled imbalances and reduced high frequency "suck out", at the same time as it is easy to manufacture since the conductive shield can be applied in the same operation as the pairs are twisted in a twisting machine.

BRIEF DESCRIPTION OF THE DRAWINGS

Reference will now be made, by way of example, to the accompanying drawings, in which.

DETAILED DESCRIPTION

This section gives detailed description about embodiments of the present invention. The following detailed description of the exemplary embodiments refers to the accompanying drawings. The same reference numbers in different drawings identify the same or similar elements. Also, the following detailed description does not limit the invention. Instead, the scope of the invention is defined by the appended claims.

Figure 1:
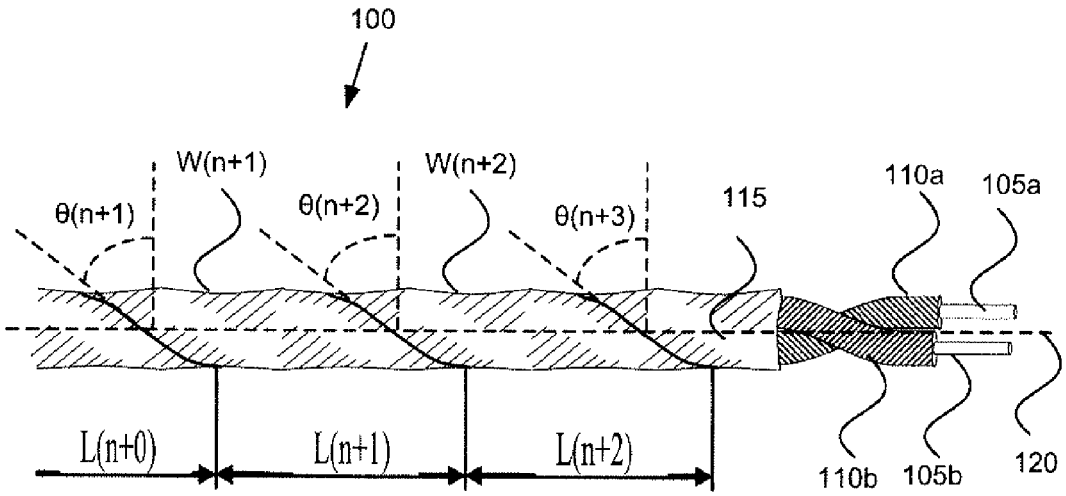
FIG. 1 schematically illustrates a perspective view of a shielded twisted wire pair according to an embodiment of the invention.

FIG. 1 schematically illustrates a perspective view of a twisted wire pair 100 in a cable according to an embodiment of the invention. Even though the figure shows a twisted wire pair, the invention may also be applied to twinaxial wires. As seen the cable comprises two conductors 105*a*, 105*b* surrounded by two dielectrics 110*a*, 110*b*. The pair of conductors including the dielectrics is twisted and surrounding the twisted pair is a conductive shield 115, also called screen, layer or foil. The width of the conductive shield is preferably constant and relatively small compared to the length of the cable. The conductive shield improves the crosstalk performance of the cable by reducing electrical noise from other signals transmitted on the cable and also reduces electromagnetic radiation from the cable that may interfere with other electrical devices. The conductive shield also eliminates capacitive coupling from other electrical sources (e.g. nearby cables).

Commonly, the conductive shield 115 is helically wrapped around the twisted pair in the same operation as the pair is twisted. Since the width of the conductive shield is substantially constant throughout the length of the cable this would imply that each wrap W of the conductive shield 115 has a lay length L that is equal to the pair lay length, and the overlap of the foil will be fixed in respect to the conductor's orientation. The pair lay length is substantially the same throughout the length of the cable, and is defined as a length along said cable during which the two conductors of the twisted wire pair twist completely about each other three hundred sixty degrees. The conductive shield lay length L is the length along said cable during which the conductive shield twists completely around the conductors three hundred sixty degrees. The conductive shield may be aluminium foil or any other metal with good conductivity.

According to an embodiment of the present invention, the conductive shield lay length is however set to vary along the length of the cable so that e.g. $L(n+0) \neq L(n+1) \neq L(n+2)$, where n is an integer. This lay length variation is caused by continuously or intermittently varying the angle $\theta(n+x)$ of the wrap $W(n+x)$ that is being applied to the wire pairs. So if the angle $\theta(n+2)$ is smaller than $\theta(n+1)$ this would result in the lay $L(n+1)$ being shorter than the lay $L(n+0)$ whereas if the angle θ(n+2) is larger than θ(n+1) this would result in the lay L(n+1) being longer than the lay L(n+0). The angle θ for a wrap W is defined as the angle between a longitudinal axis 120 of the wire pair and the extension direction of the visible longitudinal side of the wrap. In the FIG. 1, the conductive shield is applied from left to right resulting in that the visible longitudinal side of each wrap is the left side. Each wrap is thus overlapped by its subsequent wrap, which means that in the figure only the left side of each wrap is shown and the right sides are hidden under subsequent wraps. The width of the conductive shield is thus equal to the lay length of a wrap plus the overlap to its subsequent wrap. No part of the wire pair should be without a conductive shield whereby it is necessary to have a certain overlap or at least not a gap between adjacent wraps. According to embodiments of the invention the conductive shield lay length may be set to vary in the region of up to 10% from a mean value.

According to an alternative embodiment of the present invention (only applicable to twisted wire pairs) that achieves a result similar to the result achieved when varying the conductive shield lay length, is to vary the pair lay length along the length of the cable. This is preferably achieved by varying the twist rate with which the wires in a wire pair are twisted together. The angle can then be kept substantially constant throughout the length of the cable accordingly resulting in a constant conductive shield lay length. Alternatively, the angle θ can be varied along the cable resulting in both the conductive shield lay length and the pair lay length to vary. Preferably, if both the conductive shield lay length and the pair lay length are set to vary; these should vary independently of each other. According to this alternative embodiment, the relationship between conductive shield lay length and pair lay length differs between different wraps and varies along the length of said cable.

Figure 2:
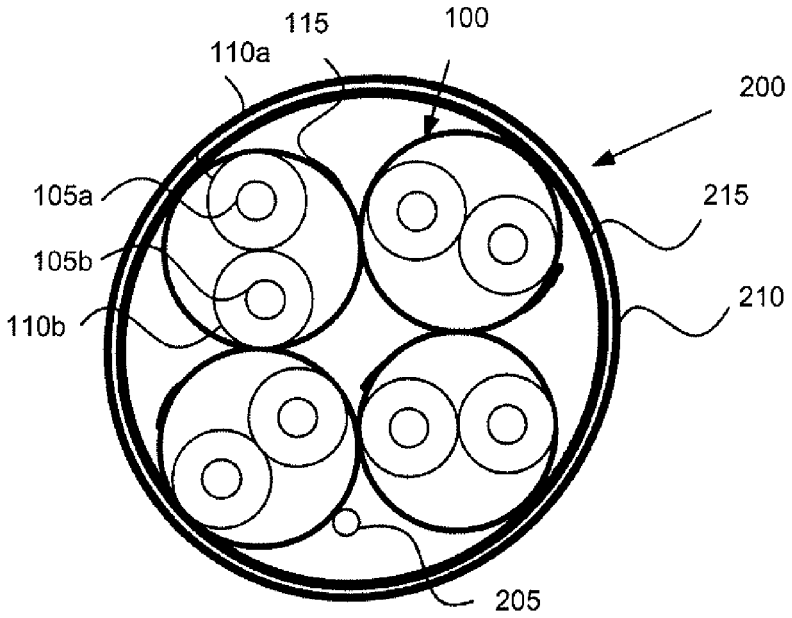
FIG. 2 schematically illustrates a cable comprising a plurality of wire pairs according to an embodiment of the invention.

FIG. 2 schematically illustrates a cable 200 comprising four wire pairs 100 according to an embodiment of the invention. The twisted pairs may have the same or different twist rates. The four wire pairs may also be twisted together to make up the cable. Preferably, a special grounding wire called a drain wire 205 is arranged within the cable having the same extension direction as the wire pairs. Drain wires 205 may also be arranged inside the conductive shields 115 in accordance with e.g. IEEE std 802.3ba-2010. Further, the plurality of wire pairs 100 can be provided with an outer metal shielding 215 covering the entire group of shielded wire pairs. This would offer an even further improved protection from interference from external sources and "alien crosstalk". Enclosing the wire pairs and an eventual shielding 215 is a dielectric layer 210.

Figure 3:
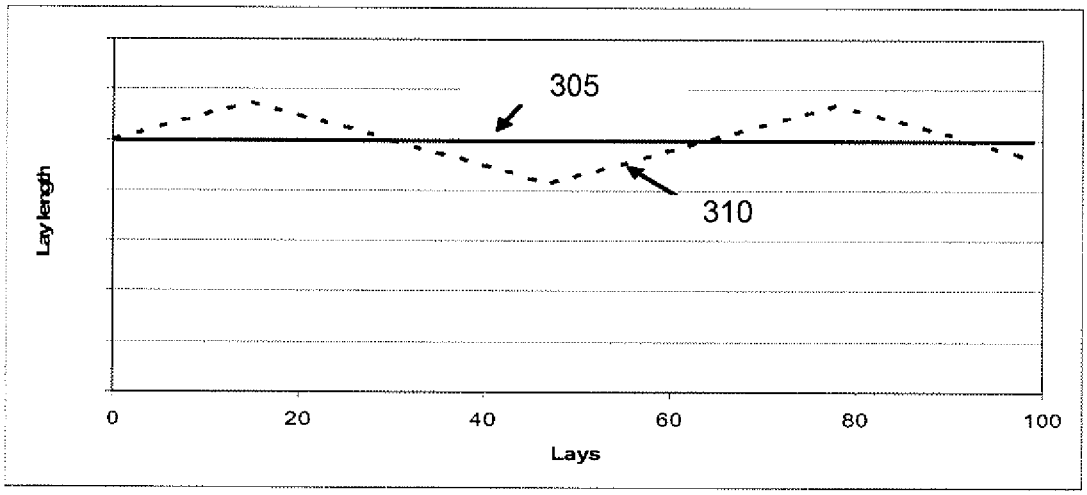
FIG. 3 schematically illustrates the relationship between pair lay length and conductive shield lay length for a wire pair according to an embodiment of the invention.

FIG. 3 schematically illustrates the relationship between pair lay length 305 and conductive shield lay length 310 for a wire pair according to an embodiment of the invention. As can be seen the pair lay length is practically constant throughout the length of the wire pair whereas the conductive shield lay length varies continuously in a triangular fashion. Some part (s) of the wire pair is provided with a conductive shield having a lay length that is larger than the pair lay length and some part(s) of the wire pair is provided with a conductive shield having a lay length that is shorter than the pair lay length.

According to an alternative embodiment of the present invention (only applicable to twisted wire pairs) the pair lay length can also be varied along the length of the cable. The conductive shield lay length can then either be kept substantially constant or be set to vary along the cable.

Preferably, the mean conductive shield lay length substantially corresponds to the pair lay length (mean pair lay length if the pair lay length is set to vary). This can be achieved by oscillating the conductive shield lay length around a mean value along the length of said cable, wherein the mean value is set to be approximately the same as the pair lay length. This oscillation may be fast or slow. For example, the oscillation may have a period of over 60 lays/wraps as in FIG. 3 or more, but it may also have a significantly shorter period, with a period of two wraps being the shortest possible where every other conductive shield lay length is longer than a mean value and every other is shorter than the mean value.

The conductive shield lay length does not have to vary in a triangular fashion but can e.g. be in the form of a saw tooth or a sine wave. It can also vary intermittently e.g. in the form of a step diagram where a number of sequential wraps have the same conductive shield lay length, even though this may reduce the effects of the invention. This number of sequential wraps having the same lay length should be limited to e.g. 5-10, if the advantages of the invention are to be maintained.

The conductive shield lay length can also be set to vary from an initial low value and continuously or intermittently increase along the entire length of the wire pair, or vice versa be set to vary from an initial high value and continuously decrease along the entire length of the wire pair. This solution is most suitable for twinaxial cables since no attention must be paid to any pair lay length.

The limit for the length of the conductive shield lay length is equal (or slightly less than) the width of the conductive shield. If the conductive shield lay length for a wrap would be larger than the width of the conductive shield, this would result in a part of the wire pair being without a conductive shield which is not suitable. The limit for how short the conductive shield lay length can be is not as crucial and the thickness of the conductive shield may be e.g. three to four layers, perhaps even more depending on the material of the conductive shield. In practice however, it may be preferred if the thickness of the conductive shield is no more than two times the thickness of the conductive shield. Therefore the conductive shield lay length for a wrap should preferably not be larger than half of the width of the conductive shield.

Figure 4:
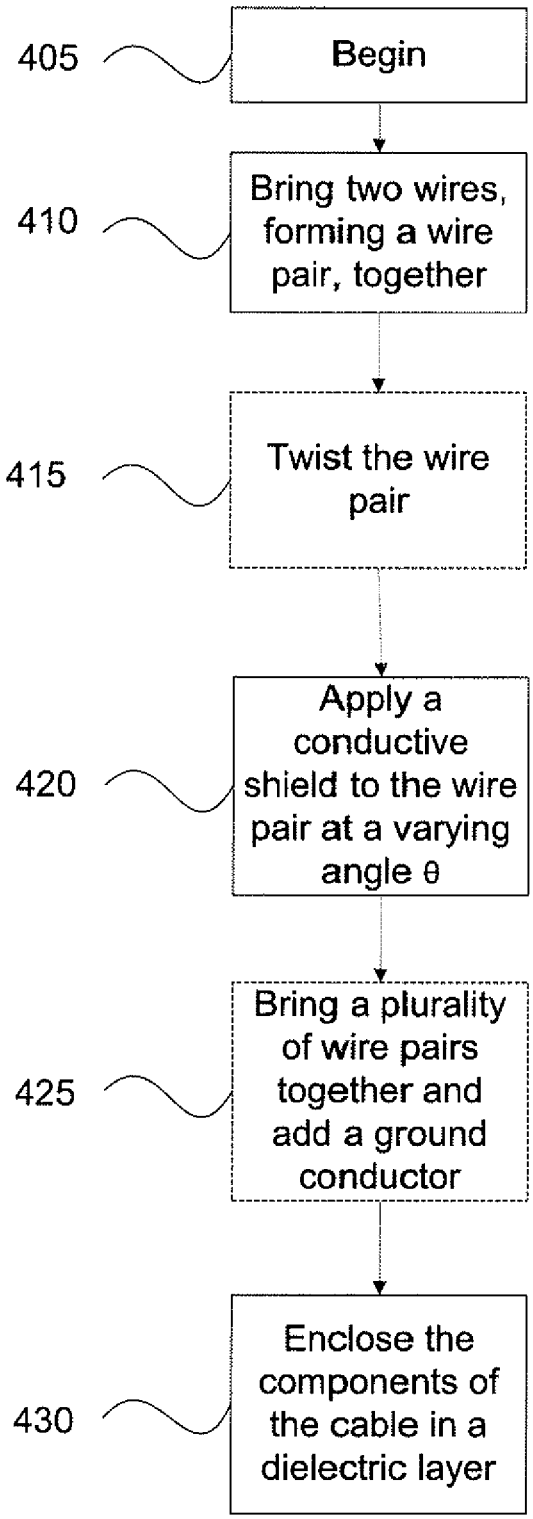
FIG. 4 schematically illustrates a flow chart of a method of producing a cable according to an embodiment of the invention.

FIG. 4 schematically illustrates a flow chart of a method of producing a cable according to an embodiment of the invention. The method begins in step 405 and in step 410 two wires are brought together making up a wire pair. If the wire pair shall be twisted this is performed in step 415. For a twinaxial cable this step 415 will be skipped.

In step 420 a conductive shield is applied to the wire pair. The conductive shield is applied by wrapping the conductive shield material in a rotational direction along and about a longitudinal axis of the wire pair. The conductive shield material is wrapped around the wire pair such that a longitudinal side of a wrap overlap a preceding wrap. Further, according to an embodiment of the present invention the angle θ with which the conductive shield is applied is varied such that the size of the overlap will differ between different wraps, and consequently the conductive shield lay length will differ between different wraps.

The different width of the overlapped wraps, due to the varying conductive shield lay lengths, will cause the position of the overlap to vary in relation to the position of the conductors. This causes the resonance or "signal suck-out" to occur at lower frequencies compared to common wire pairs having constant overlaps. Thereby this effect will occur in frequencies below the used frequency span and consequently the used frequency span can be extended upwards in frequency. Further, signals within a range of frequencies (stop-band) may be attenuated in this design.

The method of varying the angle θ is a very simple way to achieve the above mentioned advantages. For a twisted wire pair the method can be applied in a common twisting machine by adjusting the arm that decides the angle with which the conductive shield is applied. Preferably the arm is moved back and forth along the extension direction of the longitudinal axis of the wire pair resulting in a conductive shield with overlaps having different widths along the length of the wire pair. This means that the conductive shield can be applied more or less at the same time as the wire pairs are twisted. Thereby the conductive shield can be applied in the same operation as the pairs are twisted resulting in considerable time savings, compared to first twisting the wires in a twisting machine and applying the conductive shield in a separate operation in a wrapping machine. A twisting machine may operate approximately 5-10 times faster compared to a wrapping machine.

For twinaxial wires, if the shield is applied in a longitudinal fashion, the arm will have to be moved back and forth in a tangential direction in order for the conductive shield lay length to vary along the length of the wires.

The method may continue in step 425 where a plurality of wire pairs are brought together to create a cable having many wire pairs. Further, a drain wire can be added to the other wire pairs that are brought together. Finally in step 430 the wire pair(s) is/are enclosed by a dielectric layer/non-conductive shield. Under the dielectric layer, i.e. before the dielectric layer is applied, a cable shield, i.e. a conductive shield surrounding a plurality of wire pairs, can be applied.

Figure 5:
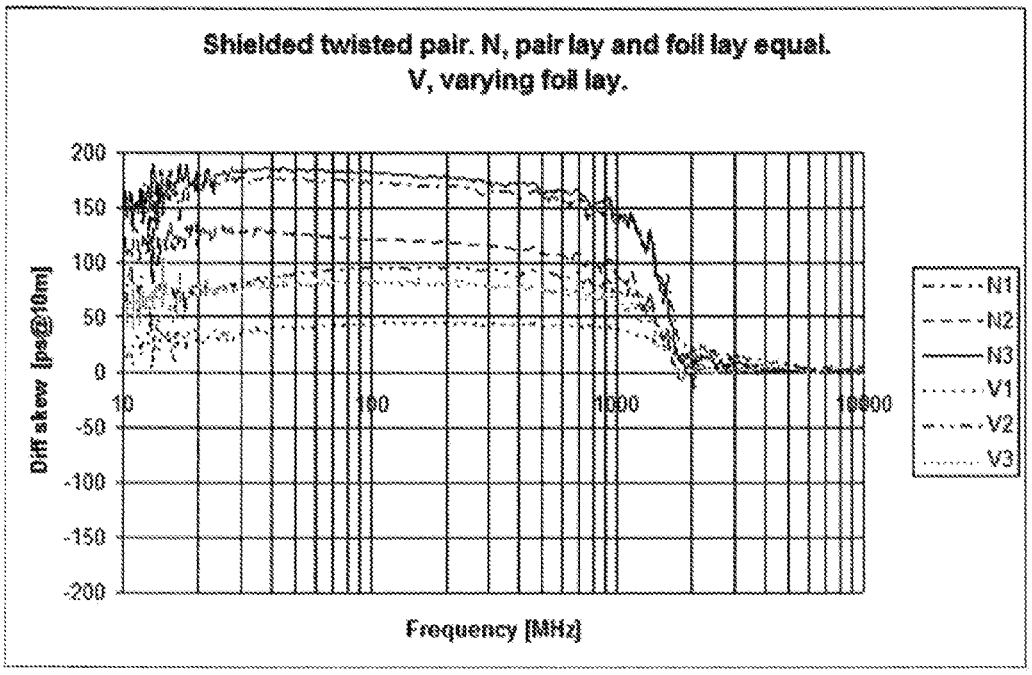
FIG. 5 is a diagram showing how differential skew varies with frequency in cables having varying and constant conductive shield lay length, respectively.

FIG. 5 is a diagram showing how differential skew varies with frequency in cables having varying and constant conductive shield lay length, respectively. Differential skew, also called in-pair skew or intra-pair skew, refers to the time difference between the two single-ended signals in a differential wire pair. This effect has become a factor degrading high speed performance in signal cables. In FIG. 5, differential skew has been measured for six different wire pairs. Three wire pairs, marked N1, N2 and N3, are provided with conductive shield lay lengths being equal to their pair lay lengths. Three wire pairs, marked V1, V2 and V3, are provided with conductive shield lay lengths that varies along the length of the wire pairs according to embodiments of the invention. As can be seen from the measurements, the wire pairs marked N1-N3 experience significantly higher differential skew compared to the wire pairs marked V1-V3.

Figure 6:
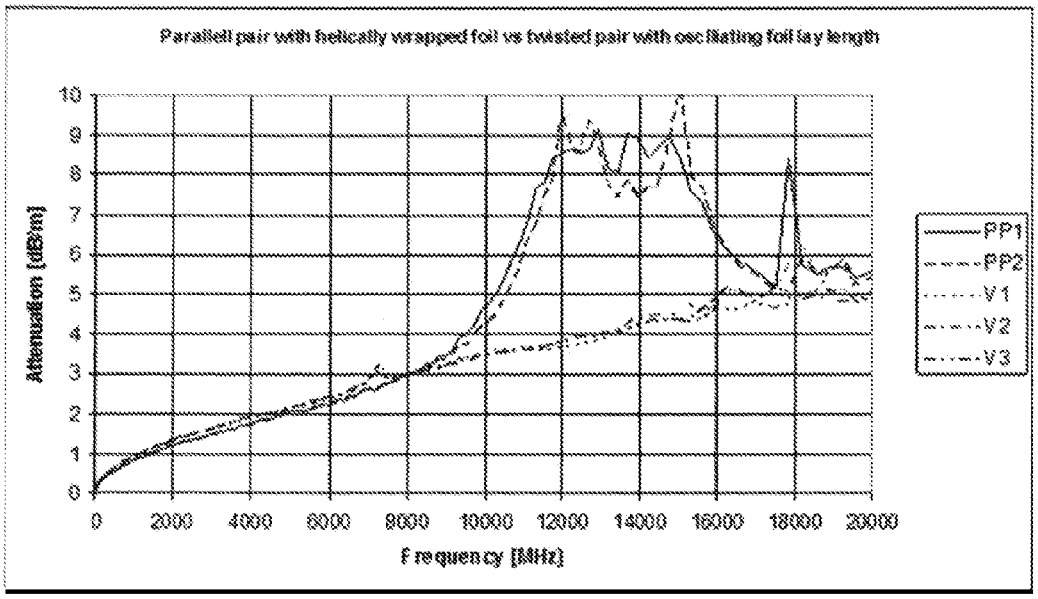
FIG. 6 is a diagram showing how attenuation varies with frequency in twinaxial and twisted pair cables having constant and varying conductive shield lay lengths, respectively.

FIG. 6 is a diagram showing how attenuation varies with frequency in twinaxial and twisted pair cables having constant and varying conductive shield lay lengths, respectively. In FIG. 6, attenuation has been measured for five different wire pairs. Two twinaxial/parallel wire pairs, marked PP1 and PP2, are provided with helically wrapped conductive shield having a constant lay length. Three wire pairs, marked V1, V2 and V3, are provided with conductive shield lay lengths that varies along the length of the wire pairs according to embodiments of the invention. As can be seen from the measurements the twinaxial wire pairs experience a significantly higher attenuation within the frequency span 10-18 GHz.

Figure 7:
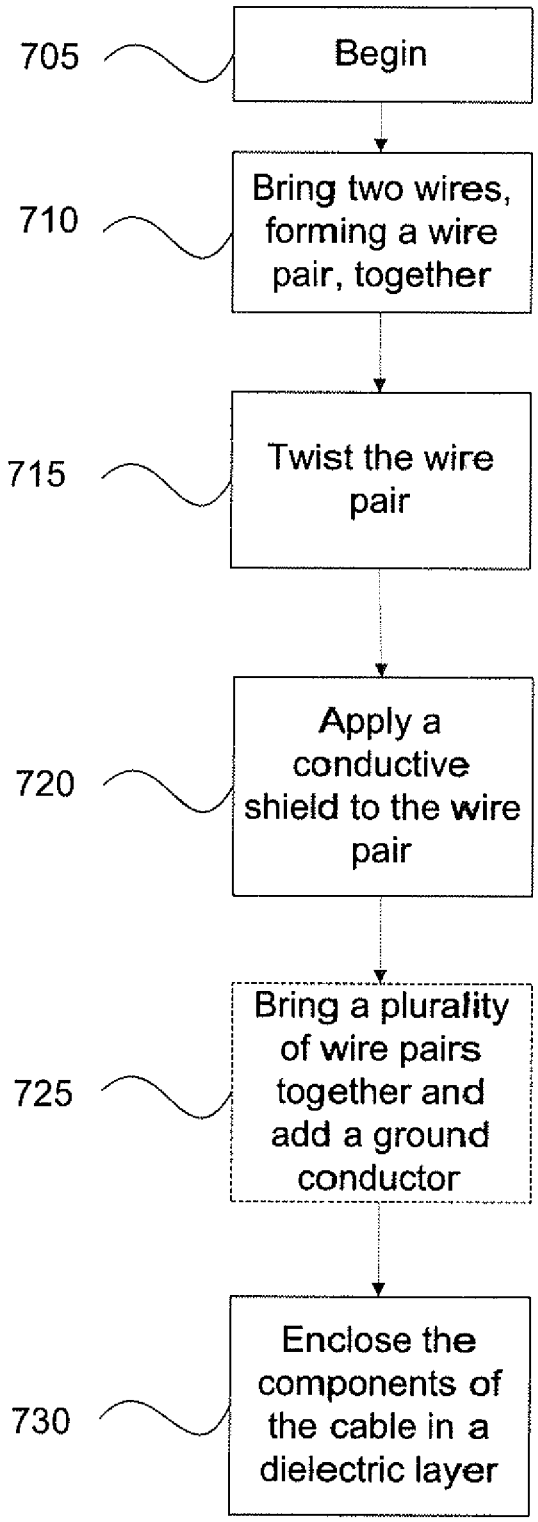
FIG. 7 schematically illustrates a flow chart of a method of producing a cable according to an embodiment of the invention.

FIG. 7 schematically illustrates a flow chart of a method of producing a cable according to an alternative embodiment of the invention. The method begins in step 705 and in step 710 two wires are brought together making up a wire pair.

In step 715 two wires making up a wire pair are twisted together. The pair lay length is varied along the length of the cable. This is preferably achieved by varying the twist rate with which the wires in a wire pair are twisted together.

In step 720 a conductive shield is applied to the wire pair. The conductive shield is applied by wrapping the conductive shield material in a rotational direction along and about a longitudinal axis of the wire pair. The conductive shield material is wrapped around the wire pair such that a longitudinal side of a wrap overlap a preceding wrap. According to an embodiment of the present invention one or more, preferably each, twisted wire pair has/have a varying pair lay length. The angle θ with which the conductive shield is applied can be set to be substantially constant or be set to vary along the length of the cable. If both the angle θ and the twist rate is set to vary along the length of the cable they should preferably vary independently of each other. The relationship between conductive shield lay length and pair lay length will thus differ between different wraps and vary along the length of the cable.

By varying pair lay length such that it differs from the conductive shield lay length, the position of the overlap will vary in relation to the position of the conductors. This causes the resonance or "signal suck-out" to occur at lower frequencies compared to common wire pairs having constant overlaps. Thereby this effect will occur in frequencies below the used frequency span and consequently the used frequency span can be extended upwards in frequency. Further, signals within a range of frequencies (stopband) may be attenuated in this design. A further advantage with a cable according to this embodiment is that it is easily manufactured since the conductive shield can be applied in the same operation as the pairs are twisted in a twisting machine.

The method may continue in step 725 where a plurality of wire pairs are brought together to create a cable having many wire pairs. Further, a drain wire can be added to the other wire pairs that are brought together. Finally in step 730 the wire pair(s) is/are enclosed by a dielectric layer/non-conductive shield. Before the dielectric layer is applied, a cable shield can be applied, i.e. a conductive shield surrounding a plurality of wire pairs.

The present invention may of course, be carried out in other specific ways than those herein set forth without departing from the essential characteristics of the invention. The present embodiments are, therefore, to be considered in all respects as illustrative and not restrictive and all changes coming within the meaning and equivalency range of the appended claims are intended to be embraced therein.

The invention claimed is:

1. A cable for signal transmission, the cable comprising:

one or more wire pairs extending in a longitudinal direction, said wire pairs including two conductors each separately surrounded by a dielectric layer;

wherein at least one of said one or more wire pairs comprises a conductive shield wrapped along and about the longitudinal axis of the wire pair in a rotational direction such that a longitudinal side of a wrap overlaps a preceding wrap, wherein the conductive shield is applied with an angle (θ) that differs between different wraps such that the conductive shield lay length (L) varies along the length of said cable.

2. A cable according to claim 1, wherein said one or more wire pairs are twisted wire pairs twisted together along the length of said cable, each twisted wire pair having a pair lay length being substantially the same throughout the length of said cable.

3. A cable according to claim 2, wherein the conductive shield lay length varies along the length of said cable such that one part of the wire pair has a conductive shield lay length larger than said pair lay length and one part of the wire pair has a conductive shield lay length shorter than said pair lay length.

4. A cable according to claim 2, wherein the mean conductive shield lay length substantially corresponds to the pair lay length.

5. A cable according to claim 1 wherein the conductive shield lay length oscillates around a mean value along the length of said cable.

6. A cable according to claim 1, wherein the conductive shield has a constant width.

7. A method for producing a cable for signal transmission, the cable comprising one or more wire pairs extending in a longitudinal direction, each of said wire pairs including two conductors each separately surrounded by a dielectric layer; the method comprising the step of:

applying a conductive shield onto each wire pair by wrapping the conductive shield along and about the longitudinal axis in a rotational direction such that a longitudinal side of a wrap overlaps the preceding wrap, wherein the step of applying the conductive shield comprises the step of varying the angle (8) with which the conductive shield is applied such that the conductive shield lay length (L) varies along the length of said cable.

8. The method according to claim 7, further comprising the step of twisting the wire pairs together along the length of said cable, such that each twisted wire pair has a pair lay length being substantially the same throughout the length of said cable.

9. The method according to claim 8, further comprising the steps of alternately increasing and decreasing the angle (θ) such that one part of the cable has a conductive shield lay length larger than said pair lay length and one part of the cable has a conductive shield lay length shorter than said pair lay length.

10. The method according to claim 8, wherein the mean conductive shield lay length is set to substantially correspond to the pair lay length.

11. The method according to claim 7 wherein the angle (θ) is varied along the length of said cable such that the conductive shield lay length oscillates around a mean value along the length of said cable.

12. The method according to claim 7, wherein the conductive shield has a constant width.

* * * * *

UNITED STATES PATENT AND TRADEMARK OFFICE

CERTIFICATE OF CORRECTION

PATENT NO. : 9,136,044 B2
APPLICATION NO. : 13/415349
DATED : September 15, 2015
INVENTOR(S) : Lindstrom et al.

It is certified that error appears in the above-identified patent and that said Letters Patent is hereby corrected as shown below:

In the Specification

In Column 1, Line 8, delete "EP 11157415" and insert -- EP 1157415 --, therefor.

In Column 5, Line 24, delete "angle can" and insert -- angle θ can --, therefor.

In the Claims

In Column 9, Line 16, in Claim 7, delete "angle (8)" and insert -- angle (θ) --, therefor.

Signed and Sealed this
Twenty-sixth Day of April, 2016

Michelle K. Lee

Michelle K. Lee
*Director of the United States Patent and Trademark Office*